US008952303B2

(12) United States Patent
Buck et al.

(10) Patent No.: US 8,952,303 B2
(45) Date of Patent: Feb. 10, 2015

(54) COOKING DEVICE, ESPECIALLY DOMESTIC COOKING DEVICE

(75) Inventors: Bernd Buck, Windelsbach (DE); Reiner Arnold, Rottenbach (DE); Laurent Jeannatau, Compiegne (FR)

(73) Assignee: Electrolux Home Products Corporation N.V., Zaventem (BE)

( * ) Notice: Subject to any disclaimer, the term of this patent is extended or adjusted under 35 U.S.C. 154(b) by 910 days.

(21) Appl. No.: 12/594,631

(22) PCT Filed: Mar. 6, 2008

(86) PCT No.: PCT/EP2008/001785

§ 371 (c)(1),
(2), (4) Date: Oct. 5, 2009

(87) PCT Pub. No.: WO2008/122334

PCT Pub. Date: Oct. 16, 2008

(65) Prior Publication Data

US 2010/0243640 A1 Sep. 30, 2010

(30) Foreign Application Priority Data

Apr. 10, 2007 (EP) ..... 07007313

(51) Int. Cl.

| | |
|---|---|
| ***H05B 6/12*** | (2006.01) |
| ***H05B 3/68*** | (2006.01) |
| ***F24C 15/10*** | (2006.01) |
| ***F24C 7/08*** | (2006.01) |

(52) U.S. Cl.

CPC ..... *F24C 15/104* (2013.01); *F24C 7/082* (2013.01)

USPC ..... 219/622; 219/620; 219/458.1

(58) Field of Classification Search

CPC ..... H05B 3/06; H05B 3/748; H05B 3/746; H05B 3/70; H05B 3/68; H05B 3/76; H05B 3/742; H05B 3/744; H05B 6/12; H05B 6/062; H05B 6/1209; F24C 15/104; F24C 15/10

USPC ..... 219/622, 630, 660, 624, 460.1, 459.1, 219/461.1, 465.1, 443.1, 448.11, 620, 219/458.1; 126/275 E, 218; 267/80; 403/52; 16/29

See application file for complete search history.

(56) References Cited

U.S. PATENT DOCUMENTS

| | | | | |
|---|---|---|---|---|
| 5,142,609 | A | 8/1992 | Hilscher et al. | |
| 2009/0212043 | A1 * | 8/2009 | Keishima et al. | 219/647 |

FOREIGN PATENT DOCUMENTS

| | | |
|---|---|---|
| DE | 1146638 | 4/1963 |
| FR | 1150226 | 1/1958 |
| WO | WO 2006082753 A1 * | 8/2006 |

OTHER PUBLICATIONS

International Search Report for PCT/EP2008/001785, dated Apr. 23, 2008, 2 pages.

* cited by examiner

*Primary Examiner* — Quang Van
*Assistant Examiner* — Hung D Nguyen
(74) *Attorney, Agent, or Firm* — Pearne & Gordon LLP

(57) ABSTRACT

A cooking device having an electrical heating element is arranged on a carrier element. At least one electrical wire is connected with the carrier element. The connection is facilitated by a reception element having two recesses forming undercuts and a connection member with a basis structure and an electrical contact for engagement with the wire. The connection member has two protrusions extending from the basis structure of the connection member and can be inserted into the recesses.

10 Claims, 3 Drawing Sheets

COOKING DEVICE, ESPECIALLY DOMESTIC COOKING DEVICE

Figure 1:
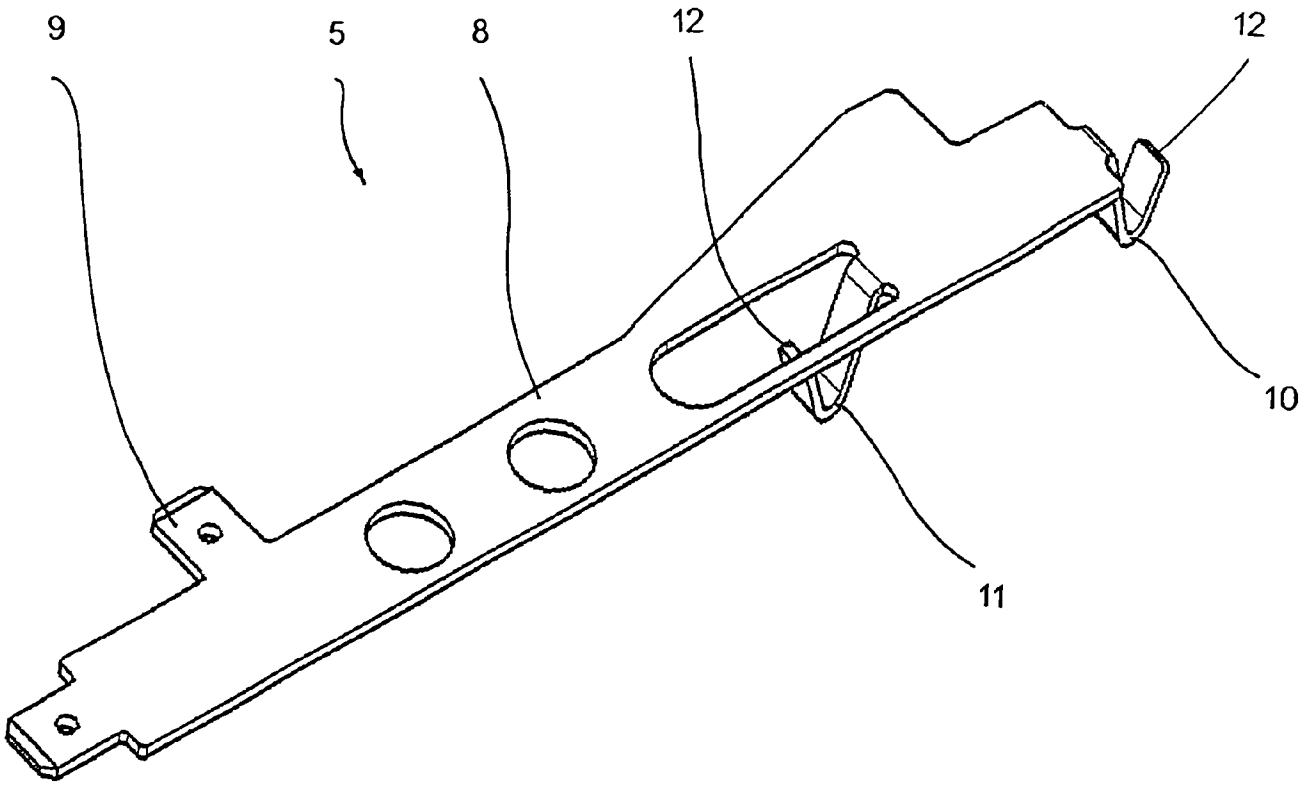

The invention relates to a cooking device, especially to a domestic cooking device, having an electrical heating element arranged on a carrier element, wherein at least one electrical wire is connected electrically with the carrier element by connection means.

Domestic cooking devices or hobs especially of the induction heating type are well known in the art. An induction cooking unit especially for the use in home are capable of safely being used with existing metal base pans or other cooking vessels without risk of damage to the induction cooking unit. Induction cooking units are designed to inductively heat pans and other metal base cookware which are fabricated from stainless steel, iron, titanium or other similar lossy metallic materials. With regard to such induction heating units reference is made to U.S. Pat. No. 4,013,859.

Especially in induction cooking units it is common to connect a non-magnetic conductive shielding coil carrier by a coil carrier spring and possibly other intermediate means of metal being in contact with the spring with a carrier element. The intermediate metal part must be connected from high frequency points to a reference voltage from an inverter side.

The firm mechanical and electrical connection is important for a satisfying operation of the induction hob. Thus, sometimes a quite high expenditure is done to ensure a good electrical and mechanical coupling of the respective parts being necessary to form the induction heating unit.

Therefore, it is an object of the invention to improve the electrical and mechanical connection of the cooperating parts of the device and to facilitate the assembly of the device. Furthermore, maintenance services should be simplified by the suggested concept of a hob.

The solution of this object according to the invention is characterized in that the connection means comprise a reception element having at least two recesses forming undercuts respectively and that the connection means further comprise a connection member with a basis structure and with an electrical contact for engagement with the wire, wherein the connection member has at least two protrusions extending from the basis structure of the connection member and being arranged to be inserted into the recesses, wherein the protrusions are arranged resiliently relatively to the basis structure and wherein the protrusions lock into the undercuts in a mounted state of the connection means.

Preferably, the basis structure and the protrusions are made as a one-piece part. In this case the connection member can be made of a strip of sheet metal. Furthermore, at least one protrusion can be made by punching out a part of the protrusions from the strip of sheet metal and by bending the punched part away from the plane of the basis structure.

The connection member with the protrusions and the reception element can be arranged to form a cooperating snap-connection.

The protrusions have preferably a V-shaped contour. The end of the V-shaped protrusion being remote from the basis structure can be arranged to snap into the undercut formed by the recess.

The electrical contact of the connection member can be formed as a strip of material being arranged for engagement with an electrical wrap connection. In this case, the strip of material can have a substantial rectangular shape.

The recesses in the reception element have preferably a circular shape.

The reception element and the basis structure can have a substantial flat form along their contact area.

The heating element is preferably an induction coil.

With the suggested concept is becomes quite easy to firmly connect the cooperating parts electrically and mechanically. The mounting and—if necessary—the dismounting becomes quite easy. Thus the costs for producing and specifically of mounting is the hob are reduced. Only by placing the spring (connection member) at the right place the coil bottom is plan connected to the cold potential.

Furthermore a short electrical connection is ensured to improve the high frequency decoupling of the induction heating element.

The length of the wire can be kept short, whatever induction coil is used. This is of a substantial benefit because if the wire is too long the operation of the induction element is not efficient with respect to the frequency concern.

Thus, the advantageous solution is established by using a wireless connection to simplify the manipulation by mounting or servicing the induction coil. The electrical voltage reference is just connected by mechanical way to the chassis (carrier element).

In the drawings an embodiment of the invention is depicted.

Figure 2:
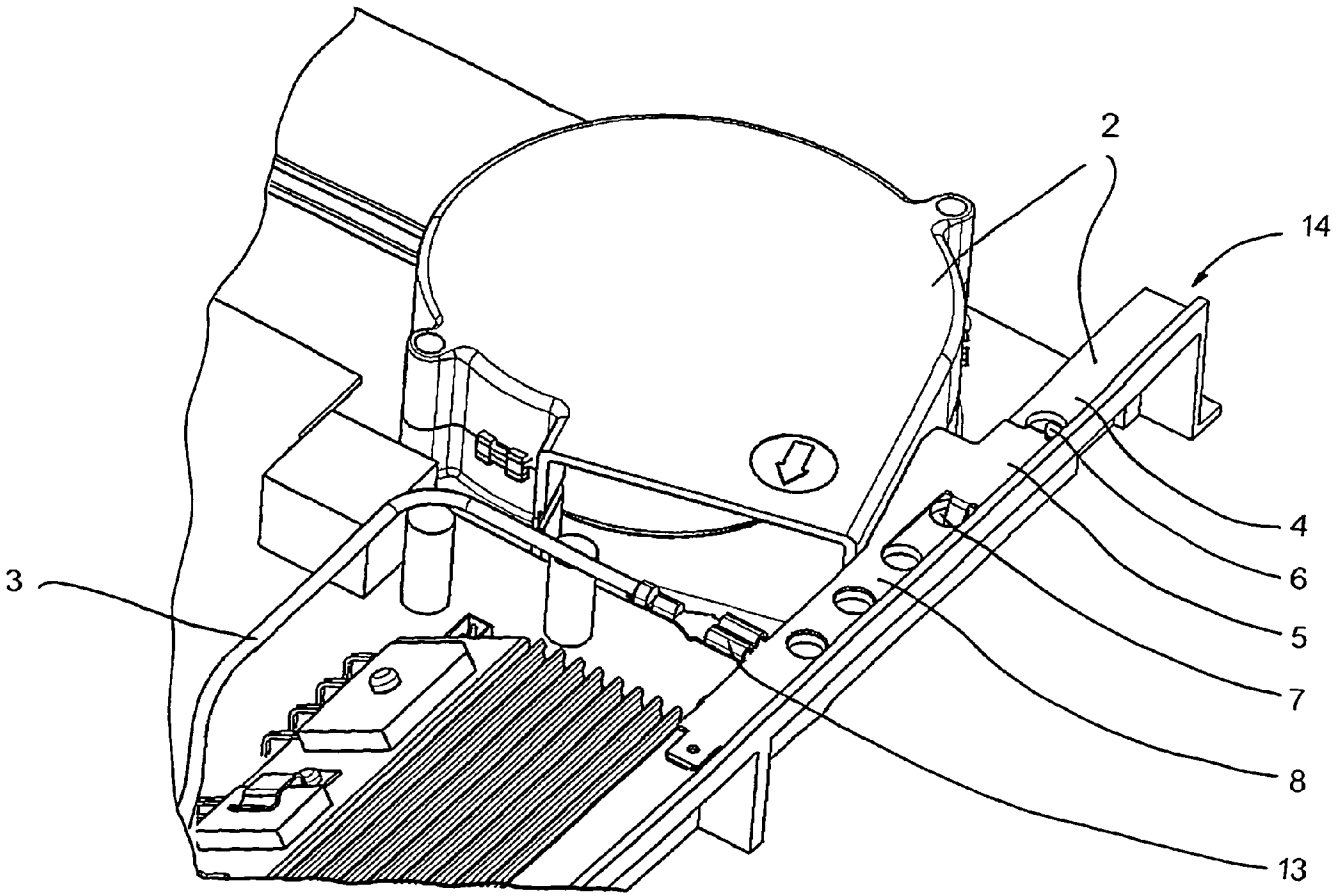
Figure 3:
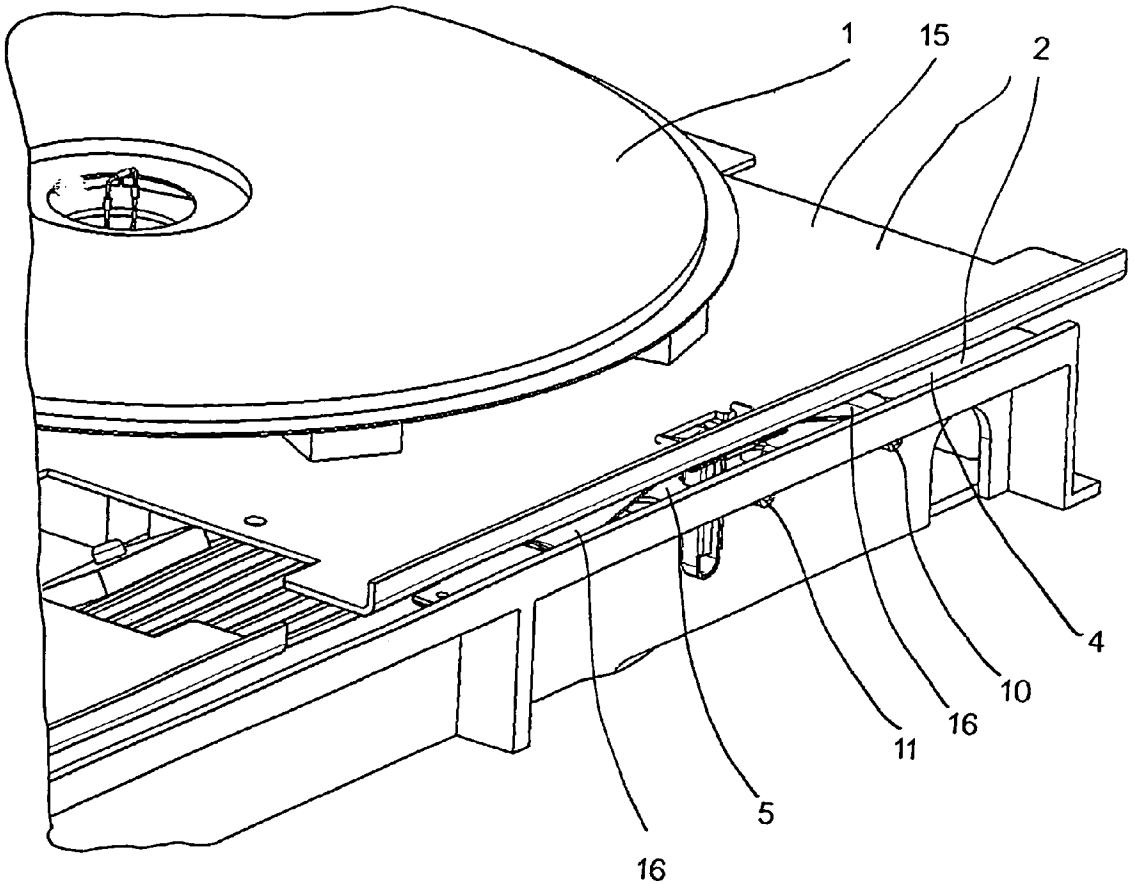

FIG. 1 shows a perspective view of a connecting member which is a part of connection means, FIG. 2 shows a perspective view of a part of a domestic induction unit, wherein the heating element is not yet mounted and FIG. 3 shows a perspective view of the part of the domestic induction unit according to FIG. 2, wherein the heating element is mounted.

Looking at FIG. 1 and FIG. 2 a carrier element 2 is provided which bears an induction heating element 1 which is shown in FIG. 3. Parts of the carrier element 2 can be addresses as coil carrier of the induction coil 1. It is important that a firm mechanical and electrical connection is ensured for an electrical wire 3 (see FIG. 2) which is necessary to establish the electrical ground for the induction heating element 1.

To achieve a simple and thus cheap and an efficient electrical and mechanical connection between the wire 3 and the carrier element 2 the following structure is suggested:

For a firm connection of the parts connection means 4, 5 are employed. The connection means 4, 5 comprise a reception element 4 and a connection member 5. The reception element 4 has a plurality of bores (see FIG. 2) which are equidistantly arranged along a strip-shaped side 14 of the carrier element 2. The bores form recesses 6, 7 which establish undercuts, i.e. an other element can grip beyond or behind the recess to establish a snap connection.

Furthermore, the connection means 4, 5 comprise the connection member 5 (as shown in detail in FIG. 1). This connection member 5 has a flat basis structure 8 and an electrical contact 9 for engagement with the wire 3.

The connection member 5 has also two protrusions 10 and 11, which extend from the basis structure 8 of the connection member 5. The protrusions 10, 11 are arranged to be inserted into the recesses 6, 7. The protrusions 10, 11 are arranged resiliently relatively to the basis structure 8, so that they can lock into the undercuts in a mounted state of the connection means 4, 5.

The resilient arrangement of the protrusions 10, 11 is achieved in the embodiment by producing the whole connection member 5 from a strip of sheet metal.

As can be seen from FIG. 1 the protrusion 10 is formed from an end part of the connection member 5 by bending a strip-shaped part to a V-shaped structure. An end 12 of the V-shaped structure 10 snaps behind the recess 6 when the protrusion 10 is inserted into the recess 6 during assembly.

In a similar way the protrusion 11 is formed from the material of the basis structure 8 by punching out a strip-shaped part of material and by bending it to the V-shaped configuration as can be seen in FIG. 1. Also here, the end 12 of the protrusion 11 is arranged to snap behind the recess 7 when inserted during assembly.

The electrical contact between the carrier element 2 and especially the connection member 5 with the wire 3 is established by an electrical wrap connection 13 at the end of the wire 3, which cooperates with a rectangular shaped part 9 of the connection member 5 (see FIG. 1).

After assembly of the connection member 5 to the bottom part of the carrier element 2 as shown in FIG. 2, an upper part 15 of the carrier element 2 is mounted forming a coil carrier. Here some connectors 16 can be employed (see FIG. 3) to establish a mechanical and electrical connection between the different parts of the carrier elements 2.

REFERENCE NUMERALS

1 Electrical heating element
2 Carrier element
3 Electrical wire
4, 5 Connection means
4 Reception element
5 Connection member
6 Recess
7 Recess
8 Basis structure
9 Electrical contact
10 Protrusion
11 Protrusion
12 End
13 Electrical wrap connection
14 Side
15 Upper part
16 Connector

The invention claimed is:

1. A domestic cooking device comprising:

an electrical heating element provided to a cooktop surface of the domestic cooking appliance;

a carrier element that couples the electrical heating element to a cabinet of the domestic cooking appliance, the carrier element comprising:

a reception element coupled to the cabinet and including a plurality of apertures that each form an undercut surface, and a connection member that cooperates with the reception element and includes a plurality of protrusions configured to be at least partially inserted into the apertures of the reception element, said protrusions being resiliently deformable to be adjusted during insertion of the protrusions into the apertures and at least partially returned to an unbiased position once insertion of the protrusions into the apertures is complete, wherein a portion of the protrusions inserted into the apertures and returned to the unbiased position cooperates with the undercut surface to lock the protrusions within the apertures;

an electrical connector provided to the connection member; and at least one electrical wire operatively connected to the electrical connector provided to the carrier element, wherein the connection member is a one-piece strip of sheet metal comprising a planar base structure and at least one of the protrusions is bent away from the plane of the base structure.

2. The device according to claim 1, wherein the connection member with the protrusions and the reception element are arranged to form a cooperating snap-connection.

3. The device according to claim 1, wherein the protrusions have a V-shaped contour.

4. The device according to claim 3, wherein an end of the V-shaped protrusion being remote from the base structure is arranged to snap into the undercut surface formed by the apertures.

5. The device according to claim 1, wherein the electrical connector of the connection member is formed as a strip of material being arranged for engagement with an electrical wrap connection.

6. Device according to claim 5, wherein the strip of material has a substantial rectangular shape.

7. The device according to claim 1, wherein the apertures in the reception element have a circular shape.

8. The device according to claim 1, wherein the reception element and the base structure have a substantial flat form along their contact area.

9. The device according to claim 1, wherein the electrical heating element is an induction coil.

10. The device according to claim 1, wherein the connection member is supported adjacent to a top side of the reception element and each of the protrusions extends through the reception element and cooperates with an under side of the reception element to maintain the connection means in a mounted state.

* * * * *